United States Patent [19]

Saito

[11] 4,061,140

[45] Dec. 6, 1977

[54] UNDERWATER BREATHING DEVICE

[76] Inventor: Masayasu Saito, No. 2-1 Higashibonoshima, Minoo, Osaka, Japan

[21] Appl. No.: 683,524

[22] Filed: May 5, 1976

[30] Foreign Application Priority Data

Feb. 2, 1976 Japan ..... 51-21384

[51] Int. Cl.[2] ..... A62B 7/00

[52] U.S. Cl. ..... 128/145 A

[58] Field of Search ..... 128/145 A, 147, 142.5, 128/142.7

[56] References Cited

U.S. PATENT DOCUMENTS

| | | | |
|---|---|---|---|
| 156,599 | 11/1874 | Schmitz | 128/145 A |
| 2,865,369 | 12/1958 | Kline | 128/147 |

FOREIGN PATENT DOCUMENTS

| | | | |
|---|---|---|---|
| 594,198 | 5/1959 | Italy | 128/145 A |

*Primary Examiner*—Robert W. Michell
*Assistant Examiner*—Henry J. Recla
*Attorney, Agent, or Firm*—Wenderoth, Lind & Ponack

[57] ABSTRACT

An underwater breathing device substantially differing from known submerging apparatuses heavily armored and applicable for deep sea exploration. This invention device is characterized by structural simplicity and ease of operation. The device comprises a float, tubular members and a mask integrally united so as to enable a user to swim submerged close to the water surface while breathing air in and out directly to and from the atmosphere via said mask and said tubular members.

1 Claim, 5 Drawing Figures

FIG. 1
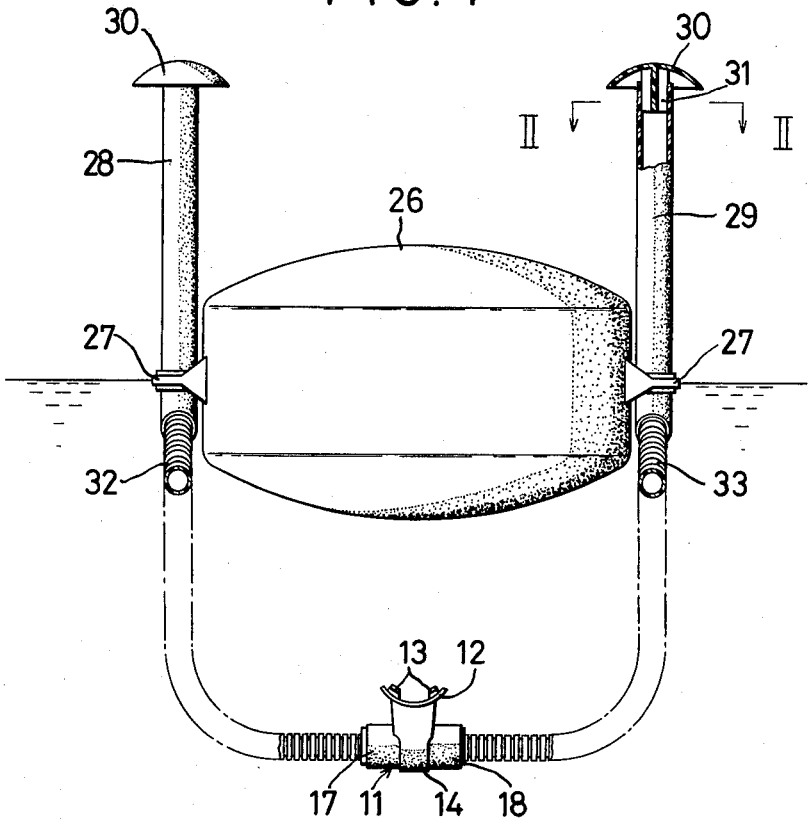
FIG. 3
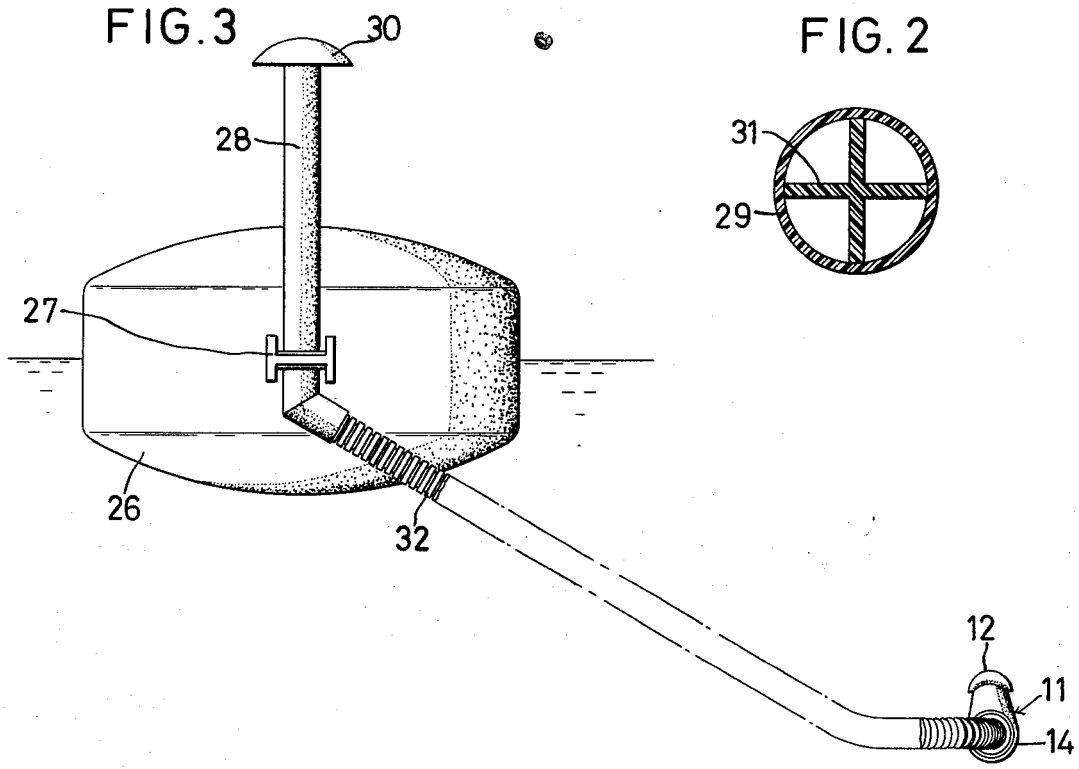
FIG. 2

UNDERWATER BREATHING DEVICE

This invention relates to an underwater breathing device and more particularly to an underwater breathing device which is structurally quite simple and easy to operate yet, the device is able to meet the demand of underwater pleasure-seekers in general and possibly comparing favorably to heavily armored diving apparatuses suited for deep sea exploration. The device comprises a float and tubular members with a mouth-mask integrally united therewith whereby a user supported by the float can swim submerged close to the water surface while inhaling and exhaling directly from and to the atmosphere through the tubular members attached to the float.

This invention, as may be self-explanatory in the above description, has for a main object to provide an underwater breathing device which is simple in constitution, easy to operate and inexpensive, so that it may be popularized among enthusiasts in submerged swimming.

This invention has for a second object to provide an underwater breathing device with a control valve through which a submerged swimmer can breath in and breath out directly from and to the atmosphere.

In order that this invention may be readily understood, reference is made to the accompanying drawings which illustrate a preferred embodiment of this invention in various examples, in which:

FIG. 1 is a front elevation of this invention.

FIG. 2 shows in enlarged scale a cross-section in plan view along II—II as shown in FIG. 1.

FIG. 3 is a side view of this invention.

Figure 4:
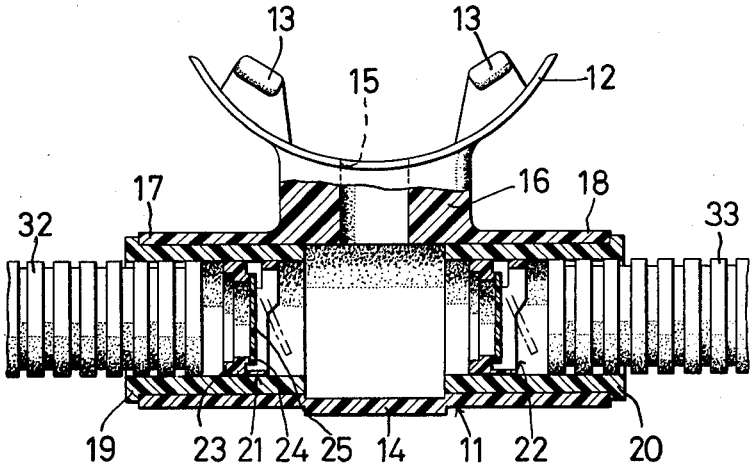
FIG. 4 is a partially-broken and partially sectional front view in enlarged scale showing a mouth-mask and joining tubular members of the device shown in FIGS. 1 and 2.
Figure 5:
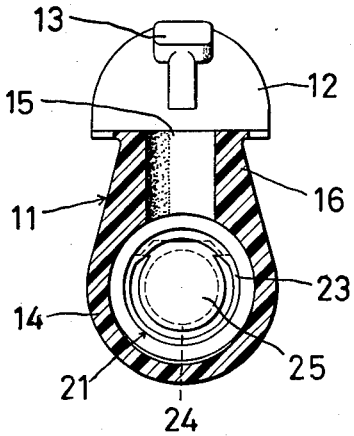
FIG. 5 is a vertical cross-section of FIG. 4.

In the drawing, a float 26 supports various breathing elements as referred to hereinafter. The float 26 is preferably a circle in plan view and a rectangle archedly projective upward and downward in side view. This float, whether pneumatic or not, has a preferable capacity of supporting a man of average weight, i.e. around 60 - 70 kg, while simultaneously keeping about a half portion of itself above the water surface.

Numeral 11 identifies a watertight mouth-mask comprising a bowl-like main body 12 and a pair of projective members 13 provided elastically so as to stably fit between the user's cheeks while the mask 11 per se fits over the mouth in a watertight state. The mask 11 must be made of elastomeric material, such as rubber, of course.

As illustrated in FIG. 4, the mask 11 at the center of the bowl-like main body 12 has an opening 15 where the mask 11 joins a downwardly projecting upsidedown T-shape cylinder 14 which comprises a vertical member 16 projecting from said opening 15 and lateral members 17 and 18 extending laterally to opposite directions from the lower end of said vertical member 16. The above-mentioned members 16, 17 and 18 form axially-cylindrical spaces respectively and thereby communicate with the mask 11 via said opening 15.

Into the lateral member 17 and 18 are inserted watertight tubes 19 and 20 respectively so that the tubes 19 and 20 slightly project outwardly from the outward end of the members 17 and 18. The tubes 19 and 20 have incorporated thereinto check valves 21 and 22 respectively for dividing the breathing route into "inhalence" and "exhalance", as further detailed hereinafter.

The check valves 21 and 22 each comprise a ring-form main body 25 fitted at its valve seat 24 to the inner periphery of each of the tubes 19 and 20. The valve members 23 are each pivotally fitted to the valve seats 24 so that the valve 23 in the tube 19 swings inwardly as air is breathed in and the other valve 23 in the tube 20 swings outwardly as air is breathed out; the valves 23 thus repeating the opening and closing of their respective tubes alternately in every alternation of inhalence and exhalence.

Into the afore-mentioned tubes 19 and 20 are watertightly inserted hoses 32 and 33 respectively. These hoses 32 and 33 extend to opposite directions laterally from the above-mentioned inserted portions but intermediately bending upwardly aslant thereby further fitting at their upper ends into lower end portions of vertical pipes 28 and 29 respectively, said pipes 28 and 29 partially bending aslant at their lower end portions so as to enable these hoses 32 and 33 to be fitted therein.

The hoses 32 and 33 are made of pressure-resistable material such as synthetic resin, light metal, etc., and are annularly pleated or spiralled at the outer periphery thereof so as to be flexible as in case of hoses use in general vacuum cleaners. In the abovementioned constitution, the hoses 32 and 33 are bendable either vertically or horizontally around the joints where they are connected to the pipes 28 and 29. Length of the hoses 32 and 33 may preferably be at the neighborhood of 100 cm so that the mouth-mask 11 may be positioned around 50 - 60 cm under the water's surface, this depth being estimated to be the maximum allowable for breathing without difficulty.

The vertical pipes 28 and 29 are each fixed by fixing means 27 to the float 26 at the vertically central position of its side at opposite ends of a diametrical extension thereof, and preferably have a length so as to project out of the water surface by about 10 - 20 cm.

An umbrella-type cover 30 is mounted on the top of each 28 and 29 by a fitting means 31 which comprises crossed plates cruciform in plan view. The fitting means 31 thus fits at its upper end to the inside surface of the cover 30 and at its sidewise edges fits to the inside surface of the pipes 28 and 29. In the above-mentioned construction, the covers 30 can prevent water from passing into the pipes 28 and 29 while enabling the air to flow smoothly therethrough from the atmosphere.

This invention may be embodied wider in range other than in the foregoing embodiment, for example replacing the mouth-mask with a face-mask. In this embodiment, the mouth-mask, despite the necessity of additional mask for the nose and eyes, is preferred from a view point that it is easier to remove in the event of an emergency forcing a user to escape urgently to the surface.

With this invention device as described hereinbefore, a user may enjoy underwater swimming free from worry about the exhaustion of oxygen and will be able to breath fresh air continuously under water as he is swimming on the surface of the water.

The user may naturally grip the hoses 32 and 33 at the horizontal portions so as to prevent unintentional detaching of the mouth-mask, of course.

What Is claim is:

1. An underwater breathing device comprising:

a float means for floating on the surface of water;

a hollow tubular T-shaped mouthpiece having a central hollow vertical member and two hollow lateral cross-members joined to said vertical member on opposite sides thereof;

first and second tubes, each tube being inserted into and slightly projecting outwardly from one of said lateral cross-members, said tubes fitting into said cross-members in a water-tight relationship;

first check valve means in said first tube for opening toward said central vertical member only when air is inhaled through said vertical member;

second check valve means in said second tube for opening away from said central vertical member only when air is exhaled into said vertical member, whereby only one of said first and second valve means is open at one time;

a first flexible hose fitted into said first tube and extending therefrom;

a second flexible hose fitted into said second tube and extending therefrom;

first and second upright pipes connected to said float means and projecting thereabove, said pipes having a vertical portion and an angled portion at the lower end thereof, said lower angled portion of said first and second upright pipes being connected to said first and second flexible hoses respectively at the end of each hose opposite the end fitted into said tube; and umbrella type cover means fitted into said vertical portion of said first and second upright pipes for preventing water from entering into said pipes.

* * * * *